United States Patent [19]

Richter

[11] Patent Number: 4,598,348

[45] Date of Patent: Jul. 1, 1986

[54] ARC LAMP SUPPORT SYSTEM

[76] Inventor: Thomas A. Richter, 640 19th St., Manhattan Beach, Calif. 90266

[21] Appl. No.: 571,923

[22] Filed: Jan. 19, 1984

[51] Int. Cl.[4] ..... F21V 15/04

[52] U.S. Cl. ..... 362/390; 362/388; 362/262; 313/149

[58] Field of Search ..... 313/238, 146, 148, 149; 362/261, 262, 269, 270, 275, 285, 287, 296, 382, 388, 390

[56] References Cited

U.S. PATENT DOCUMENTS

| | | | |
|---|---|---|---|
| 573,464 | 12/1889 | Hopkins | 362/262 |
| 839,482 | 12/1906 | Jones | 362/262 |
| 905,458 | 12/1908 | Read | 362/262 |
| 920,853 | 5/1909 | Fleming | 362/362 |
| 1,034,686 | 8/1912 | Buchanan | 362/262 |
| 1,118,684 | 11/1914 | Ross | 313/146 |
| 1,211,016 | 1/1917 | Vintla | 313/146 |
| 1,625,315 | 4/1927 | Hall | 313/149 |
| 1,629,333 | 5/1927 | Benford | 362/287 |
| 1,671,805 | 5/1928 | Bassett | 313/149 |
| 2,169,723 | 8/1939 | Desormeaux | 313/146 |
| 2,204,079 | 6/1940 | Gelb | 362/362 |
| 2,269,771 | 1/1942 | Klamm | 313/146 |
| 2,298,965 | 10/1942 | Bellman | 313/238 |
| 3,218,498 | 11/1965 | Schroeder | 313/146 |

*Primary Examiner*—Ronald H. Lazarus
*Attorney, Agent, or Firm*—Allen A. Dicke, Jr.

[57] ABSTRACT

The anode of an arc lamp is supported on an arm. When the arc lamp fails, motion of the arm detects the failure and turns the current off of the arc lamp. In addition, after failure of the lamp, the arm limits motion of the anode so that it does not strike adjacent structure.

17 Claims, 8 Drawing Figures

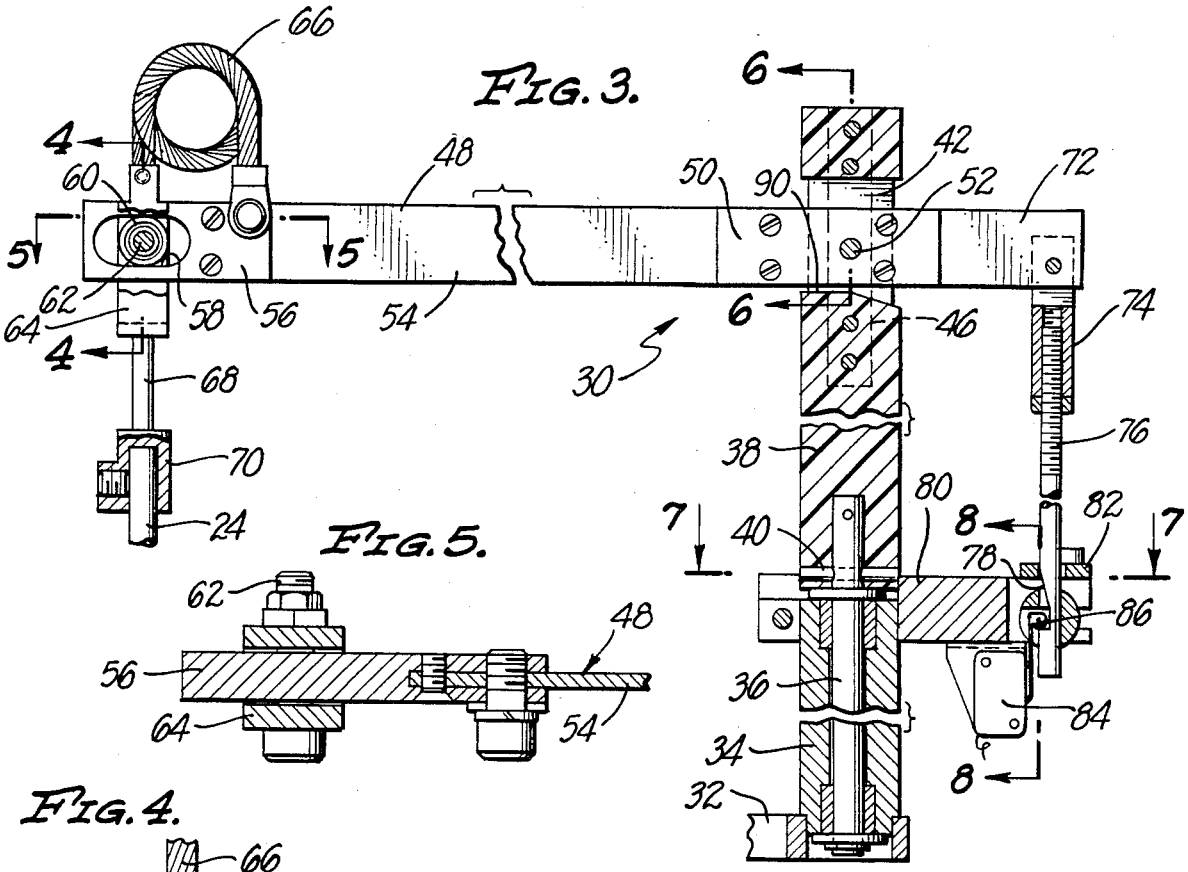
FIG. 3.
66
4
60
5
62
64
58
56
48
54
50
90
42
52
72
6
46
74
30
68
70
24
38
76
80
7
40
8
82
78
86
36
84
34
32
FIG. 5.
62
48
56
64
54
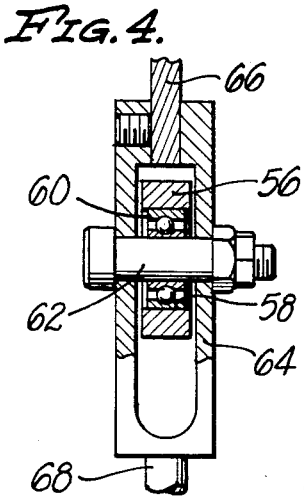
FIG. 4.
66
60
56
62
58
64
68
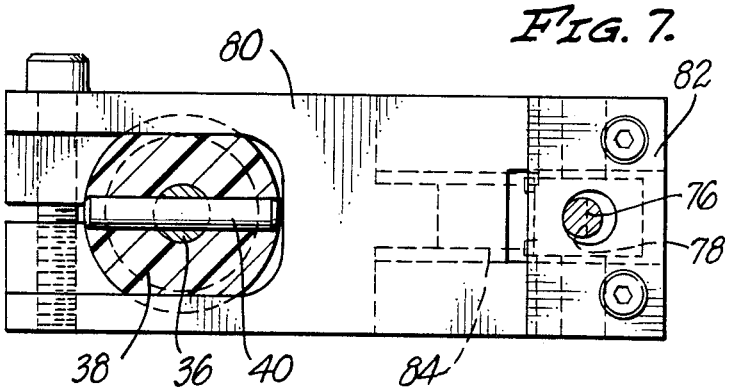
FIG. 7.
80
82
76
78
38
36
40
84
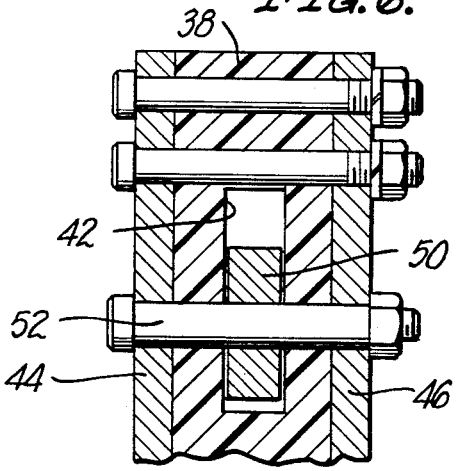
FIG. 6.
38
42
50
52
44
46
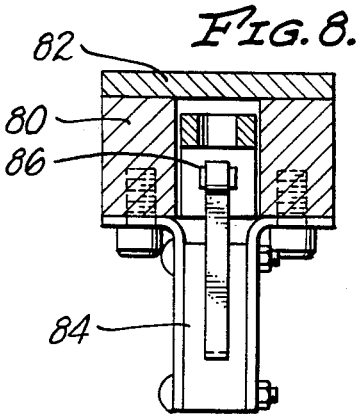
FIG. 8.
82
80
86
84

ARC LAMP SUPPORT SYSTEM

BACKGROUND OF THE INVENTION

The invention is directed to an arc lamp support system wherein the anode in the arc lamp is supported both to detect arc lamp failure and to limit motion of the anode of the broken lamp.

Arc lamps are often used in high intensity illumination systems. Each arc lamp is provided with a reflector. High intensity arc lamps are subject to failure by explosion. The anode is hot and may come into contact with the reflector. Such contact would damage the reflector both by physical contact from the very hot anode, and damage which would be produced by arcing from the anode to the reflector. The reflectors used in association with high intensity arc lamps are often carefully formed and expensive to replace. Accordingly, there is need to protect the reflector when a high intensity arc lamp explodes.

SUMMARY OF THE INVENTION

In order to aid in the understanding of this invention, it can be stated in essentially summary form that it is directed to an arc lamp support system for attachment to the anode of a high intensity arc lamp when the arc lamp is positioned within its reflector. The support system detects explosion for the turning off of arc lamp current and limits the motion of the anode after the lamp envelope fails.

It is,thus, an object and advantage of this invention to provide an arc lamp support system which protects the reflector and associated structure around an arc lamp when the arc lamp fails.

It is a further object and advantage of this invention to provide an arc lamp support system wherein the anode is supported by an arm, and the arm detects failure of the arc lamp and signals this failure to shut off the arc lamp current.

It is a further object and advantage of this invention to provide an arc lamp support system wherein an arm supports the anode so that upon failure of the lamp envelope the anode is constrained so that it cannot come into contact with the lamp reflector or other lamp structure in order to limit damages.

Other objects and advantages of this invention will become apparent from a study of the following portion of the specification, the claims and the attached drawings.

BRIEF DESCRIPTION OF THE DRAWINGS

FIG. 3 is an inlarged side elevational view of the arc lamp support system.

FIG. 4 is an enlarged section taken generally along the line 4—4 of FIG. 3, with parts broken away.

FIG. 5 is an enlarged section taken generally along the line 5—5 of FIG. 3, with parts broken away.

FIG. 6 is an enlarged section taken generally along the line 6—6 of FIG. 3, with parts broken away.

FIG. 7 is an enlarged section taken generally along the line 7—7 of FIG. 3.

FIG. 8 is an enlarged section taken generally along the line 8—8 of FIG. 3.

DESCRIPTION OF THE PREFERRED EMBODIMENT

Figure 1:
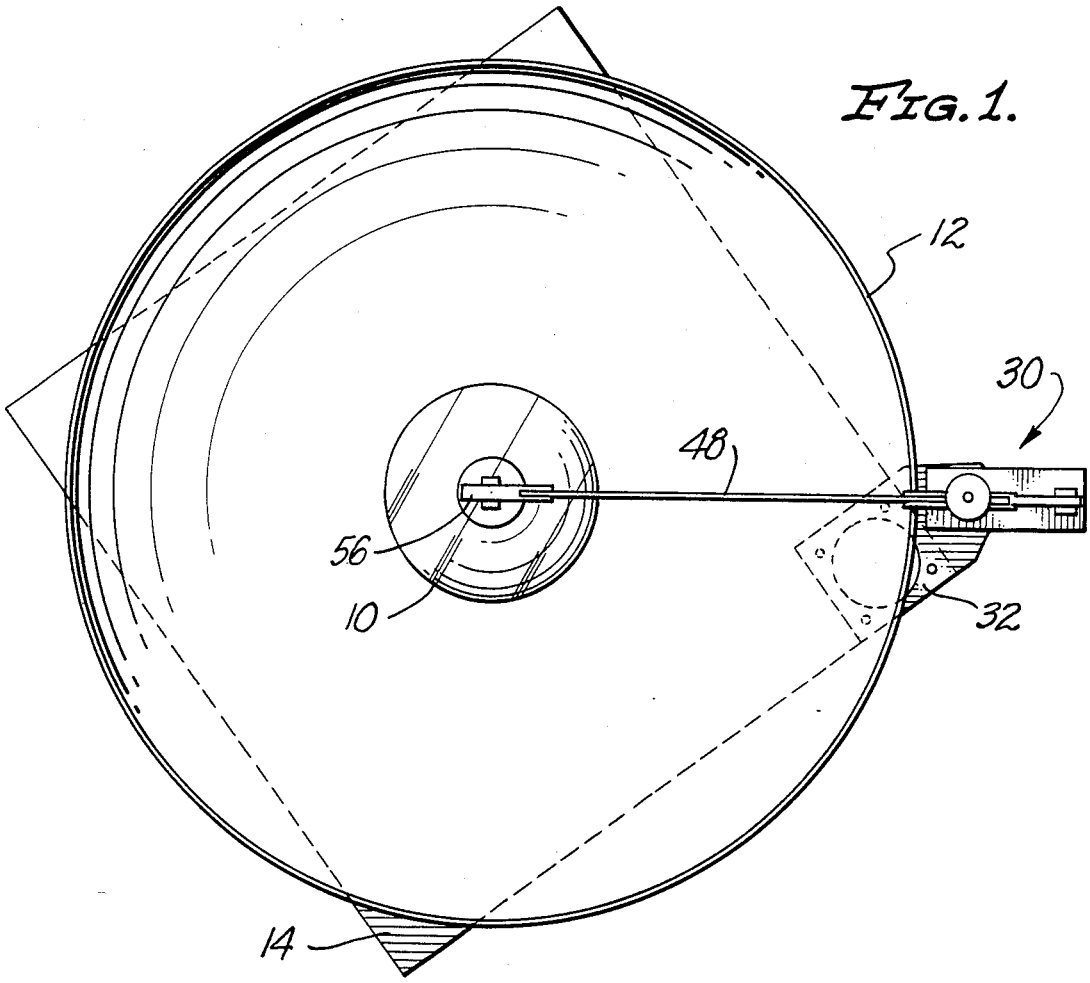
FIG. 1 is a plan view of an arc lamp with its reflector and the arc lamp support system of this invention.
Figure 2:
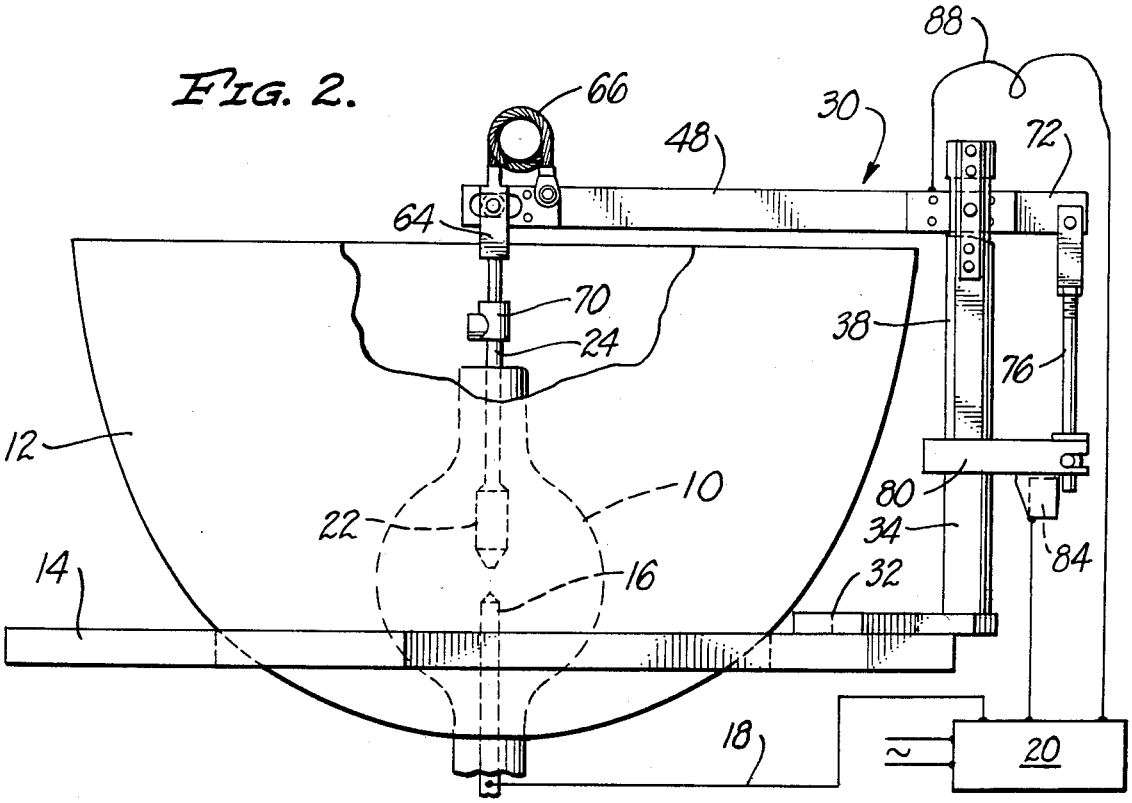
FIG. 2 is a side elevational view thereof, with parts broken away.

FIGS. 1 and 2 illustrate high intensity arc lamp 10 within its reflector 12. The reflector and the lower end of the arc lamp envelope are mounted on base 14. Cathode 16 is secured to the envelope of the lamp and is mounted on base 14. It is supplied with power through connection 18 which comes from relay 20 which receives its power from a conventional AC source. Anode 22 is positioned above the cathode. Anode stem 24 extends out of the top of the envelope.

Arc lamp support system 30 is seen in FIGS. 1, 2 and 3. Support system 30 engages with arc lamp anode stem 24 to both sense the position of the anode stem 24 and limit its excursion from that position.

Bracket 32 is mounted on base 14 and is seen in FIGS. 1, 2 and 3. FIGS. 2 and 3 show post 34 mounted on bracket 32. Shaft 36 is rotatably mounted in post 34. These parts are metallic. Insulator upright 38 receives shaft 36 in the lower end thereof. Cross pin 40 secures the parts together.

The upper portion of insulator upright 38 has cross slot 42 therethrough. Straps 44 and 46 are secured onto the outside of upright 38 at cross slot 42 in order to strengthen the upright at the ross slot. FIG. 6 shows the strap secured in place by means of through bolts. There are two through bolts above the cross slot and two therebelow, see FIG. 3. Arm 48 is made of several sections. Bar 50 extends through the cross slot 42 and is carried on pivot pin 52 which extends through straps 44 and 46 to pivotally support arm 48, as seen in FIG. 6. Bar 50 is preferably made of metal, such as brass, so that electric connection can be made thereto as illustrated in FIG. 2. Strap 54 is also metallic. Strap 54 is secured in a slot in the end of bar 50. Cap 56 is secured in a similar way on the outer end of strap 54, see FIG. 5. Cap 56 has a longitudinal slot 58 therein in which is positioned ball bearing roller 60. Pivot bolt 62 passes through roller 60. Yoke 64, see FIG. 4, embraces the cap 56 and carries pivot bolt 62. This construction is such that the yoke 64 can move forward and back in the longitudinal direction of arm 48. Electrical connector strap 66 is secured to both cap 56 and yoke 64 to provide electrical continuity therebetween. The lower end of yoke 64 carries rod 68 which has a connector 70 at its lower end. Anode stem 24 is received in the connector as is show in FIG. 3. It can be seen that this structure provides a stress free engagement with anode stem 24. Left to right freedom of anode stem 24 is permitted by roller 60 being free to move in slot 58. Motion of the anode stem 24 perpendicular to the drawing sheet in FIG. 3 is permitted by rotation of upright 38 on its axis in the plane of the paper. A motion in the up and down direction in FIG. 3 is permitted by rotation of arm 48 on its pivot pin 52. Thus, connector 70 provides freedom of motion of the anode stem 24 within operating limits.

On its other end, arm 48 carries insulator bar 72. The yoke 74 is pivoted to and depends from the insulator bar, see FIG. 3. Rod 76 is adjustably mounted within yoke 74. Rod 76 has ramp 78 thereon, with its wider portion upward in FIG. 3.

Bracket 80 is mounted on post 34 and carries guide 82 thereon which receives the lower end of rod 76. Switch 84 is mounted on bracket 80, see FIGS. 3 and 8. Operating finger 86 on switch 84 is positioned adjacent to ramp 78, as is seen in FIG. 3. Switch 84 is connected to relay 20, see FIG. 2. In addition, connector 88 connects bar 50 to relay 22 supply power to the anode. In the position show in FIGS. 2 and 3, relay 20 is energized and current is supplied to the high intensity arc lamp.

Should the arc lamp 10 explode, anode 22 is driven upward. As a result of this upward motion, rod 76 is driven down so that ramp 78 activates operating finger 86 and switch 84. This switch controls relay 20 to disconnect the power from anode 22. In addition, motion of the now free anode 22 is limited. Pivot bolt 62 can move in the left and right direction only to the extent of slot 58. Downward motion of the left end of the arm 48 is limited by stop shoulder 90 under bar 50, see FIG. 3. In addition, rotation of upright 38 on the axis of shaft 36 is limited because guide 82 is nonrotating. Thus, the distance connector 70 can move is limited. The scope of the limitation is such that the anode 22 cannot come into physical contact with reflector 12 when the envelope of high intensity arc lamp 10 is broken. In this way, reflector 12 is protected from damage by anode 22, both by physical contact and by arcing from the anode to the reflector.

In the preferred embodiment described, the lamp electrode being restrained is the anode. In other lamp mounting systems, the cathode electrode could be restrained.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An arc lamp support system comprising:

a connector for coupling to a first electrode of a high intensity arc lamp having an envelope and having first and second electrodes fixed to and within said envelope, one of said electrodes being an anode electrode and the other being a cathode electrode;

means for supporting said second electrode and said envelope;

means for supporting said connector coupled to said first electrode so that said first electrode of the high intensity arc lamp is free of forces applied by said connector to move a limited distance in any direction to substantially eliminate stress on said envelope and said connector is constrained by said connector supporting means in all directions to a limited space to limit the distance of possible travel of said first electrode upon envelope destruction.

2. The arc lamp support system of claim 1 wherein there is a base for supporting said envelope and said second electrode of the high intensity arc lamp and said means for supporting said connector includes an arm pivotally mounted with respect to said base and extending adjacent said first electrode of the arc lamp.

3. The arc lamp support system of claim 2 wherein there is a post mounted on said base and said arm is pivotally mounted on said post.

4. The arc lamp support system of claim 3 wherein these is a stop on said post to limit the pivotal rotation of said arm with respect to said post to constrain the position of said first electrode.

5. The arc lamp support system of claim 4 wherein said post is pivotally mounted with respect to said base to provide swinging of said arm about an axis different than the axis upon which said arm is pivoted on said post.

6. The arc lamp support system of claim 5 wherein said connector for connection to the high intensity arc lamp electrode is movable in a direction along the length of said arm for a limited distance in that direction.

7. The arc lamp support system of claim 6 wherein said arm has a bearing surface adjacent the end thereof oriented in a direction generally along the length of said arm and said connector is movable on said bearing surface to provide limited motion of said connector along the length of said arm.

8. The arc lamp support system of claim 7 wherein said bearing surface is in a slot in the end of said arm and a bearing engages on said bearing surface, said bearing having limited motion constrained at the ends of said slot, a yoke embracing the end of said arm, said yoke carrying said bearing and carrying said connector.

9. The arc lamp support system of claim 2 wherein said connector for connection to the high intensity arc lamp electrode is movable in a direction along the length of said arm for a limited distance in that direction.

10. The arc lamp support system of claim 9 wherein said arm has a bearing surface adjacent the end thereof oriented in a direction generally along the length of said arm and said connector is movable on said bearing surface to provide limited motion of said connector along the length of said arm.

11. The arc lamp support system of claim 9 wherein there is a post mounted on said base and said arm is pivotally mounted on said post.

12. The arc lamp support system of claim 11 wherein there is a stop on said post to limit the pivotal rotation of said arm with respect to said post to constrain the position of the electrode.

13. An arc lamp support system comprising a base;

a reflector supported by said base, said reflector having an open side, said reflector being for receiving a high intensity arc lamp having an envelope with a first electrode within said envelope facing toward said open side of said reflector;

an upright freely rotatably mounted on said base, said upright being constrained to limit motion;

an arm freely pivotally mounted on said upright on a different axis than the rotational axis of said upright with respect to said base, said arm being constrained to limited motion, said arm extending past the open face of said reflector; and means for freely supporting an electrode connector adjacent the outer end of said arm so that said electrode connector applies minimum force to said envelope and upon envelope destruction constrained motion said arm limits the motion of said electrode connector to prevent an electrode mounted therein from contacting said reflector.

14. The arc lamp support system of claim 13 wherein there is a stop on the rotation of said upright with respect to said base and a stop on the rotation of said arm with respect to said upright to constrain the motion of said electrode connector.

15. An arc lamp support system comprising a base;

a reflector supported by said base, said reflector having an open side, said reflector being for receiving a high intensity arc lamp with an electrode toward said open side of said reflector;

an upright freely mounted on said base, a stop connected to said upright to limit rotation of said upright with respect to said base;

an arm pivotally mounted on said upright on a different axis than said rotatioal axis of said upright with respect to said base, a stop connected to said arm to limit rotation of said arm with respect to said upright, said arm extending past the open face of said reflector, an electric switch connected to be actuated by motion of said arm so that said switch is actuated when motion of said arm signal explosion of the arc lamp; and means for supporting an electrode connector adjacent the outer end of said arm so that said arm limits the motion of said electrode connector to prevent an electrode mounted therein from contacting said reflector.

16. An arc lamp support system comprising a base;

a reflector supported by said base, said reflector having an open side, said reflector being for receiving a high intensity arc lamp with an electrode toward said open side of said reflector;

an upright freely mounted on said base, a stop connected to said upright to limit rotation of said upright with respect to said base;

an arm pivotally mounted on said upright on a different axis than said rotational axis of said upright with respect to said base, a stop connected to said arm to limit rotation of said arm with respect to said upright, said arm extending past the open face of said reflector, an electric switch connected to be actuated by motion of said arm so that said switch is actuated when motion of said arm signals explosion of the arc lamp, a current path through said connector and through at least a portion of said arm, and a relay connected to said switch and said arm to open the current circuit when said switch signals arc lamp destruction; and means for supporting an electrode connector adjacent the outer end of said arm so that said arm limits the motion of said electrode connector to prevent an electrode mounted therein from contacting said reflector.

17. An arc lamp support system comprising a base;

a reflector supported by said base, said reflector having an open side, said reflector being for receiving a high intensity arc lamp with an electrode toward said open side of said reflector;

an upright rotatably mounted on said base;

an arm pivotally mounted on said upright on a different axis than the rotational axis of said upright with respect to said base, said arm extending past the open face of said reflector, a longitudinal slot within said arm adjacent the end thereof, said slot having ends, a rotatable bearing within said slot, a yoke embracing said arm adjacent said slot and carrying said bearing, said electrode connector being mounted on said yoke so that said slot permits motion of said electrode connector in a direction along the length of said slot and the ends of said slot limit motion of said electrode connector in a direction along the length of said slot so that said electrode connector is free to minimize stress on the envelope of the arc lamp and said arm limits the motion of said electrode connector to prevent an electrode mounted therein from contacting said reflector.

* * * * *